United States Patent [19]

Martin et al.

[11] 3,996,882

[45] Dec. 14, 1976

[54] FLAG STORAGE AND DISPLAY DEVICE

[76] Inventors: Clarence H. Martin, 12333 E. 215th St., Hawaiian Gardens, Calif. 90716; Lynn Miller, 1070 Kings Road, Hartford, Wis. 54946

[22] Filed: Sept. 10, 1975

[21] Appl. No.: 611,921

[52] U.S. Cl. ..... 116/174; 116/173

[51] Int. Cl.[2] ..... G09F 17/00

[58] Field of Search ..... 116/173, 174, 175; 40/145 A

[56] References Cited

UNITED STATES PATENTS

| | | | |
|---|---|---|---|
| 504,987 | 9/1893 | Marum | 116/173 |
| 1,359,818 | 11/1920 | Marr | 116/173 |
| 1,742,481 | 1/1930 | Miller | 116/173 |
| 3,792,680 | 2/1974 | Allen | 116/173 |

FOREIGN PATENTS OR APPLICATIONS

| | | | |
|---|---|---|---|
| 16,997 | 2/1913 | Denmark | 116/173 |

*Primary Examiner*—S. Clement Swisher
*Assistant Examiner*—Denis E. Corr
*Attorney, Agent, or Firm*—Fulwider, Patton, Rieber, Lee and Utecht

[57] ABSTRACT

A flag storage and display device comprising a fixed lower housing, a connector pivotally connected to the top of the lower housing and an upper housing rotatably mounted on the top of the connector. An electric motor is mounted in the lower housing and linked to the connector to cause pivotal movement of the connector and upper housing between a vertical position for display of the flag and a horizontal position for projection and retraction of the flag. A second electric motor mounted within the upper housing controls the rotation of the storage roller to which the flag is attached. The flag extends outwardly through a slot in the upper housing, such housing preferably being eccentrically weighted so that the slot automatically moves to a downwardly directed position when the upper housing is pivoted to the horizontal position.

8 Claims, 6 Drawing Figures

FIG. 1
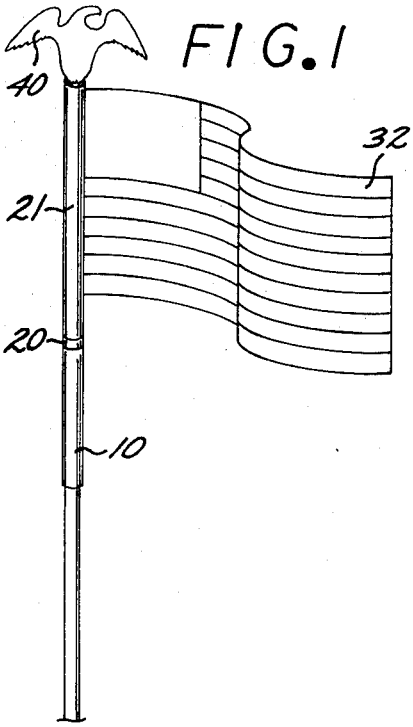
FIG. 2
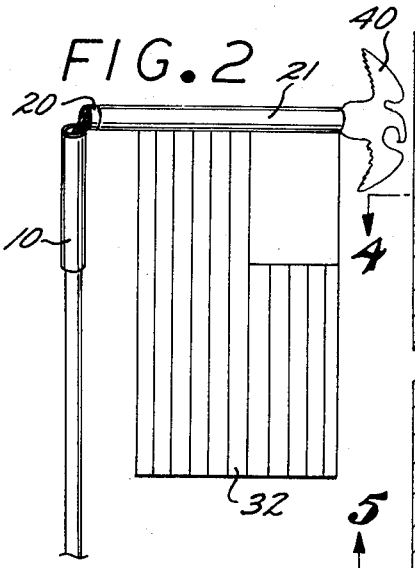
FIG. 3
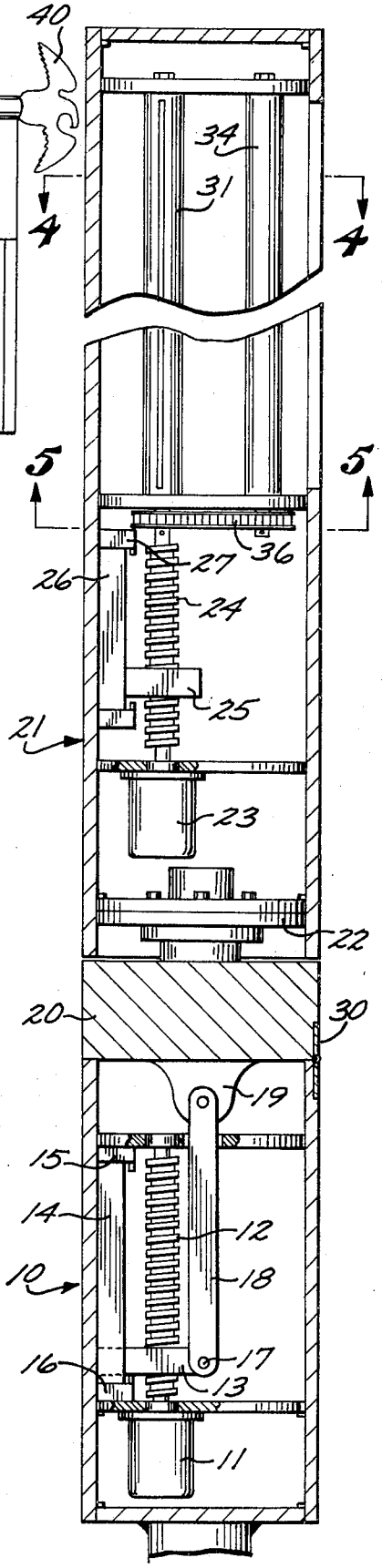
FIG. 4
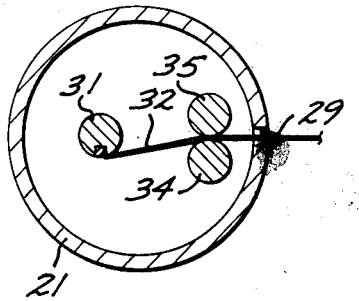
FIG. 5
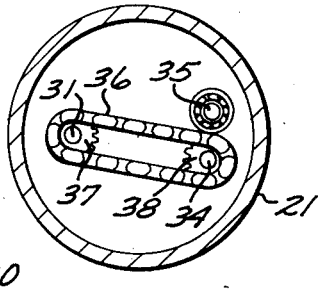
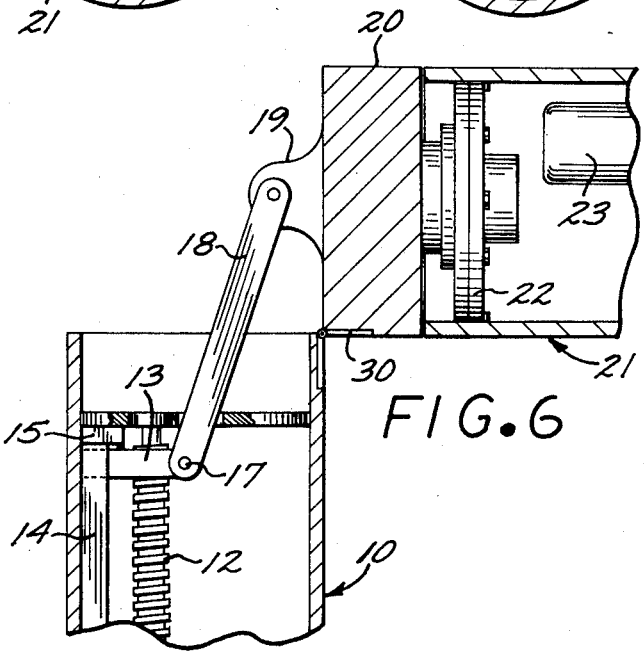
FIG. 6

FLAG STORAGE AND DISPLAY DEVICE

BACKGROUND OF THE INVENTION

1. Field of the Invention

The invention relates to a flag storage and display device which is particularly adapted for remote and/or automatic operation.

2. Description of the Prior Art

The prior art discloses numerous and various types of flag display and/or storage devices, but no suitable means is provided for preventing fouling or entanglement of the flag while it is moved between storage and display positions. In particular, no means is provided for moving the flag storing portion of the device to a horizontal position before the flag is moved between its storage and display positions. The prior art also teaches no suitable structure for remote or automatic operation of a flag storage and display device.

SUMMARY OF THE INVENTION

In essence, the invention contemplates a flag storage and display device in which a pivotally mounted flag storing portion is mounted for pivotal movement from a vertical position to a horizontal position to provide tangle-free projection and retraction of the flag.

The invention further provides means whereby the slot through which the flag is projected and retracted is automatically moved to a downwardly directed position whenever the flag carrying portion of the device is moved to a horizontal position.

The device is adapted for remote and/or automatic electric operation through a pair of electric motors which are sequentially operated to first move the flag carrying portion of the device to horizontal position, then move the flag to projected or retracted position, and then move the flag carrying portion back to a vertical position.

DESCRIPTION OF THE DRAWINGS

FIG. 1 is a side elevational view of the device in use on the top of a flag pole with the flag disposed in display position;

FIG. 2 is a similar view showing the upper portion of the device in horizontal position;

FIG. 3 is an enlarged sectional view of the device in fully vertical position, with the flag and vane omitted;

FIG. 4 is a sectional view of the flag projection and retraction rollers taken on line 4—4 of FIG. 3;

FIG. 5 is a similar view taken on line 5—5 of FIG. 3;

FIG. 6 is an enlarged sectional view of the pivoting portion of the device with the upper portion shown pivoted to horizontal position.

DESCRIPTION OF THE PREFERRED EMBODIMENT

A preferred embodiment which has been selected to illustrate the invention comprises a lower housing 10, which is adapted to be mounted in a fixed position adjacent to the top of a flagpole, sign, building, vehicle or other appropriate location.

Mounted within the lower part of the lower housing 10 is an electric motor 11, the operation of which causes rotation of a vertically directed worm gear 12. The midportion of a horizontally directed collar 13 engages the threads of the worm gear 12. One end of the collar 13 is mounted for sliding vertical movement within a vertically directed track 14 which extends along the inside of the lower housing 10.

Operation of the motor 11 causes rotation of the worm gear 12 to move the collar 13 vertically upwardly or downwardly within the lower housing 10. Limit switches 15 and 16 are provided adjacent to the top and bottom ends of the track 14 to turn off the motor 11 when the collar 13 approaches either end of the worm gear 12.

The opposite end of the collar 13 is pivotally attached by a pin 17 to the lower end of a pivot arm 18. The pivot arm 18 extends vertically upwardly beyond the upper end of the lower housing 10 and is pivotally attached at its upper end to a plate 19 which projects downwardly from the lower end of a connector 20.

The lower end of the connector 20 is pivotally connected to the upper end of the lower housing 10 by a hinge 30. Operation of the motor 11 to cause upward movement of the collar 13 to its uppermost position also causes simultaneous upward and angular movement of the pivot arm 18, as illustrated in FIG. 6 of the drawings. This causes pivotal movement of the connector 20 with respect to the lower housing 10, so that the connector moves from a vertical to a horizontal position.

An upper housing 21 is mounted for 360° rotation on a bearing 22 which joins the upper housing 21 to the connector 20.

A second electric motor 23 is mounted within the lower portion of the upper housing 21, the operation of which causes rotation of a vertically directed second worm gear 24. The midportion of a horizontally directed second collar 25 engages the threads of the second worm gear 24. One end of the second collar 25 is mounted for sliding vertical movement within a vertically directed second track 26 which extends along one side of the upper housing 21 adjacent to the second worm gear 24.

The upper end of the second worm gear 24 is connected to a vertically directed rotatably mounted storage roller 31. A flag 32 or the like is attached along its inner edge to the storage roller 31. The inner portion of the flag 32 extends between a vertically directed rotatably mounted drive roller 34 and a vertically directed rotatably mounted idler roller 35 disposed adjacent thereto, as shown in FIG. 4 of the drawings. From the rollers 34 and 35, the flag 32 extends outwardly through the slot 29 in the side of the upper housing 21.

A link drive 36 connects a pair of gears 37 and 38 which are mounted on the lower ends of the storage roller 33 and the drive roller 34, as shown in FIG. 5 of the drawings. Rotation of the second worm gear 24 accordingly causes simultaneous rotation of the storage roller 31 and the drive roller 34.

Operation of the second electric motor 23 causes rotation of the second worm gear 24 to move the second collar 25 upwardly or downwardly within the upper housing 21. A pair of limit switches 27 and 28 are provided adjacent to the top and bottom ends of the second track 26 to turn off the second electric motor 23 when the second collar 25 approaches either end of the second worm gear 24.

In use, the electric motor 11 is operated first whenever the flag 32 is to be moved from storage to display position or vice versa. As described above, operation of the motor 11 to move the collar 13 upwardly causes movement of the pivot arm 18 to move the connector 20 and upper housing 21 to a horizontal position with respect to the lower housing 10.

As shown in FIG. 4, of the drawings, the drive roller 34 and idler roller 35 are disposed on one side of the upper housing 21 adjacent to the slot 29 through which the flag 32 extends. The upper housing 21 is accordingly eccentrically weighted so that when it is moved to horizontal position, it will automatically rotate on the bearing 22 to a position in which the slot 29 is directed downwardly.

The second electric motor 23 is then operated to cause rotation of the second worm gear 24. This causes rotation of the storage roller 31 to which it is connected and, through the link drive 36, causes simultaneous rotation of the drive roller 34. Operation of these rollers causes the flag 32 to be moved inwardly or outwardly through the slot 29 in the upper housing 21.

In stored position, the flag 32 is wound around the storage roller 31 within the upper housing 21, except for its outer edge, which projects outwardly through the slot 29. The flag 32 is accordingly held in a protected position. In display position, the flag 32 is projected substantially in its entirety outwardly from the upper housing 21 except for its inner edge which extends between the rollers 34 and 35 and is connected to the storage roller 31.

When the flag 32 has been fully projected or returned, the electric motor 11 is again operated to move the connector 20 and upper housing 21 back to a vertical position.

It will be noted that because projection and retraction of the flag take place while the upper housing 21 is disposed in a horizontal position, with the slot 29 directed downwardly, the flag 32 will not become twisted or entangled during its movement in either direction.

Operation of the motors 11 and 23 may be performed through manual control or may be performed automatically through any suitable type of timing or control device which is known to those skilled in the art.

The electrical control circuit is preferably arranged so that the power supply to the first electric motor 11 is opened when the collar 13 engages the upper limit switch 15. The power supply to the second electric motor 23 may then be connected for rotational movement of the second worm gear 24 in either direction. That circuit is in turn opened when the second collar 25 engages either of the limit switches 27 and 28. The power supply to operate the first electric motor 11 in the opposite direction is then connected, being opened when the collar 13 engages the lower limit switch 16.

A vane 40 which is shown in FIGS. 1 and 2 of the drawings, may be used to cause rotational movement of the upper housing 21 with respect to the connector 20 so that the slot 29 and flag 32 are always disposed on the side of the upper housing 21 opposite from the direction in which the wind is blowing. This lessens the likelihood of the flag becoming entangled. An outwardly projecting vertically directed vane may also be provided along the side of the upper housing 21 adjacent to the slot 29 for the same purpose.

We claim:

1. A storage and display device for use in connection with a flag, said device comprising an upper housing having a storage roller rotatably mounted therein, said flag having its inner edge connected to said storage roller, said upper housing being mounted for pivotal movement between a vertical position for the display of said flag and a horizontal position for the projection and retraction of said flag with respect to said upper housing; a fixed lower housing; a pivot arm operatively connected to said upper housing; a first motor mounted within said fixed lower housing and operatively connected to said pivot arm for selectively moving pivotally said upper housing between said vertical and horizontal positions, and a second motor for rotating said storage roller to project or retract said flag with respect to said upper housing while said upper housing is disposed in horizontal position.

2. The structure described in claim 1, and a connector disposed between said upper housing and said lower housing, the upper end of said pivot arm being attached to the lower end of said connector, said upper housing being mounted for 360° rotation on the upper end of said connector.

3. The structure described in claim 2, said second motor being mounted within the lower part of said upper housing.

4. The structure described in claim 3, said upper housing having a slot, said flag extending outwardly through said slot, a rotatably mounted drive roller and a rotatably mounted idler roller disposed within said upper housing adjacent to said slot, said flag extending between said drive roller and said idler roller, and means connecting said drive roller to said storage roller for simultaneous rotation of said storage roller and drive roller.

5. The structure described in claim 4, said drive roller and idler roller being disposed adjacent one side of said upper housing so that said upper housing is eccentrically weighted so as to rotate automatically to a position in which said slot is directed downwardly when said upper housing is moved to a horizontal position.

6. The structure described in claim 5, and a vane carried by said upper housing, said vane being adapted to rotate said upper housing automatically to a position in which said slot is disposed on the side of said upper housing opposite from the direction in which wind is blowing.

7. The structure described in claim 5, and switch means for automatically controlling the operation of said motors.

8. The structure described in claim 7, said switch means including a limit switch engageable at the end of each operation of said motors in either direction.

* * * * *